United States Patent [19]

McKibben

[11] 4,077,873

[45] Mar. 7, 1978

[54] VIBRATORY SEPARATOR

[76] Inventor: Richard K. McKibben, 618 Knight Way, La Canada, Calif. 91011

[21] Appl. No.: 600,641

[22] Filed: Jul. 31, 1975

[51] Int. Cl.[2] ..... B07B 1/38

[52] U.S. Cl. ..... 209/332; 209/319; 209/366.5; 209/363; 209/385; 74/87

[58] Field of Search ..... 209/366, 366.5, 367, 209/332, 315, 405, 408, 403, 385, 386, 380, 379; 74/87, 319, 415, 363, 364; 259/DIG. 42, 437–440, 415; 308/187; 184/26, 31; 64/15 B

[56] References Cited

U.S. PATENT DOCUMENTS

| | | | |
|---|---|---|---|
| 494,355 | 3/1893 | Wagandt | 209/403 X |
| 543,088 | 7/1895 | Gray | 209/332 X |
| 555,461 | 2/1896 | Morrison | 209/332 |
| 569,211 | 10/1896 | Landes | 209/332 X |
| 658,700 | 9/1900 | Butler | 209/332 |
| 946,782 | 1/1910 | Munger | 209/315 |
| 2,197,435 | 4/1940 | Niemeyer | 209/403 |
| 2,402,340 | 6/1946 | Parmenter | 209/306.5 X |
| 2,511,239 | 6/1950 | Behnke | 209/403 |
| 2,874,840 | 2/1959 | Simpson | 209/380 X |
| 2,894,455 | 7/1959 | Lambert | 209/403 UX |
| 3,035,700 | 5/1962 | McCausland | 209/405 |
| 3,150,080 | 9/1964 | Miller | 209/366 X |
| 3,217,561 | 11/1965 | Allgaier | 209/366 X |
| 3,273,409 | 9/1966 | Nolman | 209/366 X |
| 3,522,740 | 8/1970 | Hynes | 74/87 |
| 3,650,401 | 3/1972 | Riesbeck | 209/386 X |
| 3,704,631 | 12/1972 | Marks | 259/DIG. 42 |
| 3,796,188 | 3/1974 | Bradstreet | 209/355 X |
| 3,891,191 | 6/1975 | Choules | 259/DIG. 42 |

FOREIGN PATENT DOCUMENTS

| | | | |
|---|---|---|---|
| 1,231,152 | 4/1960 | France | 209/386 |
| 379,176 | 4/1922 | Germany | 209/366 |
| 574,410 | 1/1946 | United Kingdom | 209/366.5 |

*Primary Examiner*—Robert Halper

*Attorney, Agent, or Firm*—Fulwider, Patton, Rieber, Lee & Utecht

[57] ABSTRACT

A separator of the vibratory type comprising a box assembly of a plurality of planar pan screens resiliently suspended on a support base for vibratory motion thereon by resilient tension springs mounted between the box assembly and surrounding base truss members. The pan screens in the box assembly are formed of cylindrical sleeve frames and a circular screen having an elastomeric ring about its outer periphery with an external rim grooved to receive the lower edge of the superior sleeve frame. The pan screens are assembled into the box assembly by a plurality of tie rods disposed about the outer periphery of the box assembly to axially compress the assembly and screens into position and assure their support of material. The upper edge of each of the sleeve frames is deflected inwardly to telescopically receive the lower edge of the superior pan screen and effect radial deflection of the elastomeric ring of the superior pan screen when the assembly is compressed. The undersurface of the box assembly bears a center column which is positioned within a bearing shell, and the latter is coupled to a prime mover by a gyration isolating coupling which is formed by a pair of plates interconnected by a plurality of elastomeric bands which loop outwardly, radially and axially between the plate and which serve to isolate the horizontal and tilting motions from the drive system. Positioned between the center column and the isolation coupling is a gyration generator that comprises an eccentrically loaded bearing shell that receives the lower end of the center column in upper and lower bearing races and that bears eccentric weights on its outside surface to impart the desired gyration of the box assembly. The eccentricity of the weights on the bearing shell is fixedly adjustable to control the horizontal and vertical components of the gyration of the box assembly. The bearing shell has a bottom closure plate and serves as a lubricant reservoir to function with lubricant circulation system that includes a pitot tube mounted at the bottom inner periphery of the bearing shell to circulate lubricant through the system and lubricate the upper and lower bearing races. Individual pan screens may be provided with upper and under screen sweeps to deblind the screens.

22 Claims, 12 Drawing Figures

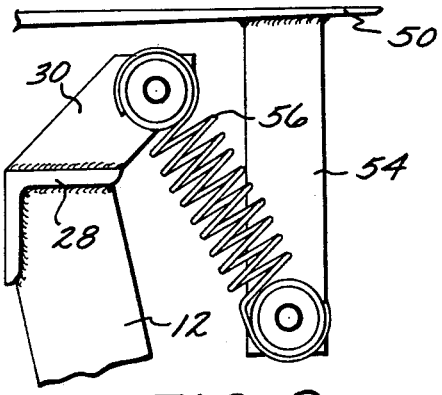
FIG. 2
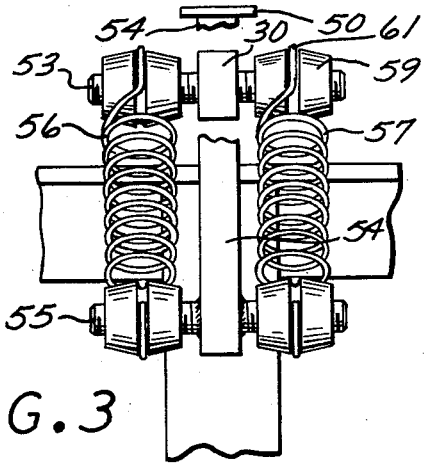
FIG. 3
FIG. 5
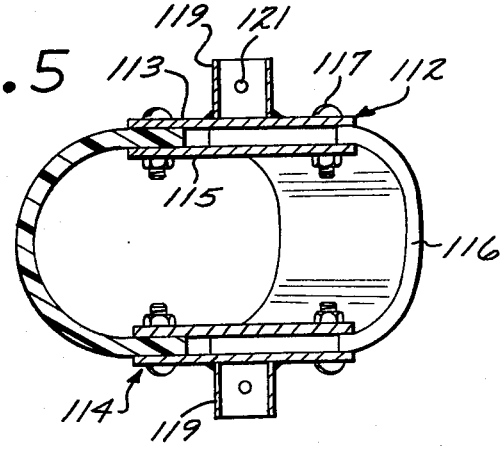
FIG. 7
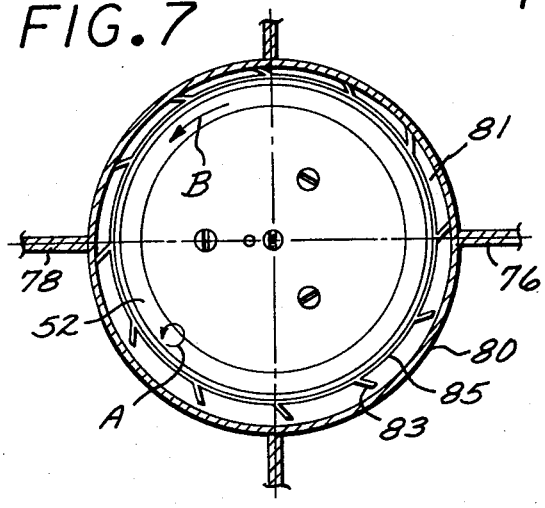
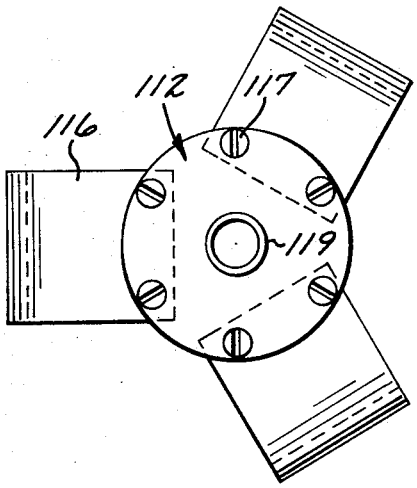
FIG. 4
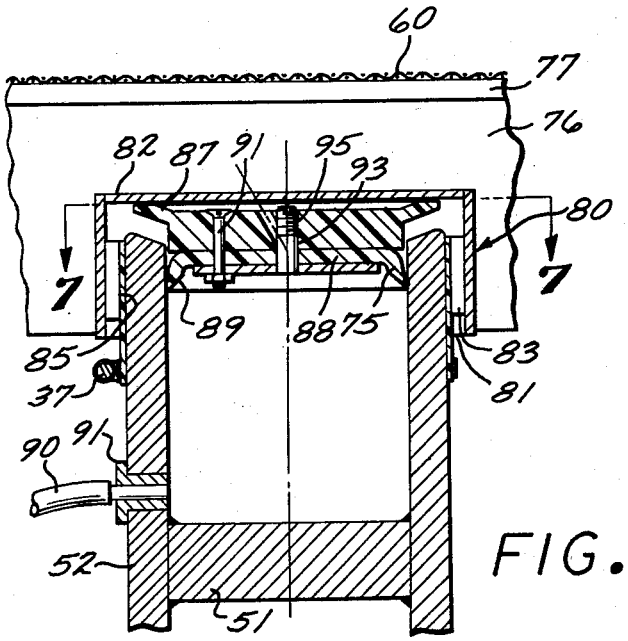
FIG. 6

VIBRATORY SEPARATOR

BACKGROUND OF THE INVENTION

1. Field of the Invention

This invention relates to a separator of the gyratory type and, in particular, to a separator in which motion is imparted to one or an assembly of pan screens to separate pulverulent or fibrous materials according to particle size or for separating particulate materials from a liquid suspension.

2. Description of the Prior Art

Various constructions have been proposed for gyratory devices used for effecting separation of particles. Generally, such separators have comprised an assembly of one or more of pan screens that are resiliently suspended on a support base and are driven by a gyration generator. As presently constructed, these devices are subject to a number of design limitations which result in frequent mechanical failure and maintenance. Commonly, the assembly of pan screens is supported on the frame or base by a plurality of circumferential compression springs that extend vertically between the lower extremity of the assembly and the supporting base. This construction tends to accentuate the side loadings, resulting in sagging and instability of the assembly and premature spring failure.

The individual screens of the pan screens must commonly be axially stressed to prevent screen slapping or undesired vertical vibration of the screen. This is performed by axially deflecting the center of the screen to provide a conical, rather than horizontal, screen. This method prevents use of a simple screen sweep and, furthermore, unnecessarily complicates and stresses the screen structure.

A design limitation in prior devices uses eccentric weights driven directly by an electric motor whose substantial mass is added to the mass of the sprung vibrating assembly, requiring higher eccentric forces and resultant higher bearing loads for an equal vibration amplitude.

Some systems have provided for screen deblinding and cleaning by placing balls or rings on the screens to impart a cleaning motion. These systems are not entirely satisfactory because they impart localized screen stresses by impacts of resilient balls or encounter jamming of the sliding elements.

BRIEF STATEMENT OF THE INVENTION

This invention comprises a vibratory device which comprises a box assembly of a plurality of pan screens that is resiliently mounted on a support base for vibratory motion thereon by resilient coil tension springs extending between base support truss members circumferentially disposed about the base and opposite, box assembly truss members extending subjacently and laterally outwardly of the base support truss members. The coil springs are secured to the truss members by retainer spools of molded elastomer and are disposed in pairs, mounted side by side, on opposite sides of the truss members.

Each of the pan screens which are assembled into the box assembly comprises a cylindrical steel frame having an upper end deflected radially inwardly to telescopically receive the lower edge of a superior pan screen. The screens of the pan screens comprise a circular screen disk having an elastomeric ring about its outer periphery with an upstanding ring that has a circular groove to receive the lower edge of the superior screen sleeve. When the lower edge of the superior screen sleeve is placed in the circular groove and the pan screen is placed in the assembly and compressed on the upper edge of the subjacent pan screen frame, the elastomeric ring is placed in shear and tension, resulting in a tension loading of the screen. In this manner, adequate screen tensioning is provided without the necessity to deflect the center of the screen from its horizontal plane.

The box assembly of pan screens bears a center column secured to the undersurface of the lowermost member which is supported within a bearing shell. The bearing shell is connected to a prime mover by a gyration isolating coupling that is formed by a pair of plates interconnected by a plurality of elastomeric bands that loop outwardly radially and axially between the plates.

The device is also provided with an inertia gyration generation means that is positioned about the center column of the box assembly and comprises an eccentrically loaded bearing shell that receives the lower end of the center column and upper and lower rolling bearings. The bearing shell carries upper and lower, adjustable eccentric weights on the upper and lower bearing planes to provide the desired horizontal and vertical gyrations to the assembly.

The bearing shell has a bottom closure plate and serves as a lubricating oil reservoir. The device is provided with a lubricating oil circulation system including a pitot tube located at the bottom inner periphery of the bearing shell to pump the oil through the filter of the circulation system and remove solid particles such as metal chips and the like from the lubricating oil.

In the preferred embodiment, the device is provided with upper and under screen sweep means. The under screen sweep means which deblinds the undersurface of an individual screen comprises an assembly of radial arms carried on a hub in the form of an inverted cup. The individual screens are provided with a centrally located, subjacent cylinder that bears a piston which is forced upwardly by gas pressure supplied through an independent pressured gas system. The inverted cup hub of the lower screen sweep overlies the center cylinder of the screen and the piston carried therein which bears upwardly against the undersurface of the hub to provide a bearing support.

A gas port is provided in the piston to vent gas against the undersurface of the hub and thereby provide a gas bearing between the piston and the cup. The cup is of greater diameter than the center cylinder to provide an annulus therebetween and flexible axial ribs carried on the outside wall of the center cylinder extend across the annulus into contact with the inner walls of the cup. Under the gyration of the box assembly, these axial ribs effect rotary motion of the screen sweep means to brush particles from the undersurface of the screen.

Preferably, suitable screen sweep means are also provided on the upper surface of the screens. Such upper screen sweep means comprise a frame with radial screen contact members carried thereon and resting on the pan screen with rotary motion means carried at the periphery of the frame in the form of a plurality of leaf springs bearing outboard shoes that contact the wall of the pan and translate the vibratory motion of the pan into rotary motion of the upper screen sweep.

BRIEF DESCRIPTION OF THE DRAWINGS

The invention will now be described by reference to the figures of which:

FIGS. 2 and 3 illustrate the resilient suspension of the pan screens;

FIGS. 4 and 5 illustrate the gyration isolating coupling means of the device;

FIG. 6 is a view of the lower screen sweep bearing and rotary drive means;

FIG. 7 is a view along lines 7—7′ of FIG. 6;

DESCRIPTION OF THE PREFERRED EMBODIMENT

Figure 1:
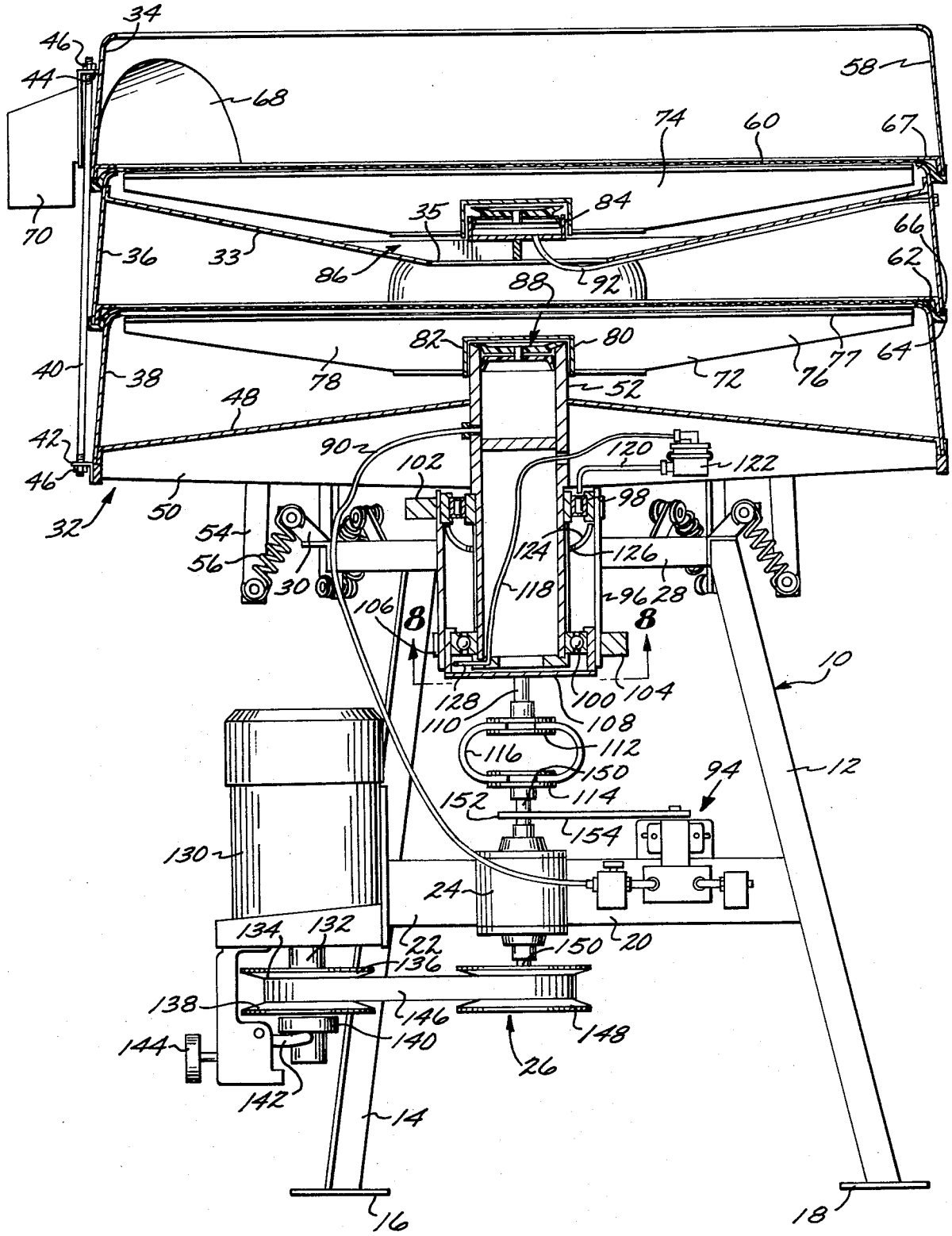
FIG. 1 is a sectional elevation view of the the device.

Referring now to FIG. 1, the invention is shown as a vibratory device having a support base generally indicated at 10 defined by a plurality of support legs such as 12 and 14 that bear foot plates 16 and 18. The stand has three legs such as 12 and 14 positioned at 120° increments. Each leg bears a lowermost rail such as 20 and 22 which radially extend to a central sleeve 24 that provides a bearing journal for the drive system generally indicated at 26. The upper ends of the legs such as 12 and 14 terminate in connection with an upper ring member 28 which carries a plurality of base support trusses such as 30 positioned at regular and equal angular increments about ring 28.

The box assembly, generally indicated at 32, of the device comprises a plurality of pan screens 34, 36 and 38 that are retained by a plurality of tie rods such as 40 which extend from brackets 42 carried on the lowermost pan screen 38 and similar brackets 44 carried on the uppermost of the pan screens. These tie rods bear conventional fastening means such as threaded ends which are retained by conventional nut members 46. The lowermost pan screen 38 bears a bottom sheet metal plate 48 that is preferably conical, inclined downwardly about its periphery to facilitate the movement of material on this pan to its periphery for removal through peripheral discharge means not illustrated in the drawing. The intermediate pan screens such as 36 bear frustoconical baffle plates 33 with a central opening 35 to collect material and redirect it to the center of a subjacent screen.

The bottom plate 48 is supported by a plurality of radial gussets 50 that extend to the periphery of the pan and that are secured at their inboard ends to center column 52. Each of radial gussets 50 supports downwardly extending box assembly truss members 54. The truss members 54 extend subjacent to and radially outside of the base truss members 30 and resilient means in the form of tension coil springs 56 are connected between the ends of these truss members to provide a suspension support of the box assembly 32. The construction thus described provides a vertical as well as lateral bias of the springs urging the sprung mass upwardly and inwardly toward the center of the device, stabilizing the assembly in a manner described in greater detail hereinafter.

Each pan screen, such as 34, 36 or 38, of the assembly 32 comprises a generally conical sleeve 58, formed of sheet metal, and a substantially horizontal screen 60. The upper ends of each of the conical sleeves 58 are of lesser diameter than their bases and thereby provide a telescopic support for the immediately superior pan screen. Screen tensioning means are provided in the form of a resilient ring 62 of a suitable elastomer which has an outer peripheral rim 64 bearing a groove 66 for receiving the lower edge of sleeve frame 58. This assembly provides for placing the ring 62 in shear and tension when the box assembly is compressed by tie rods 40, tensioning the screens 60 in a manner hereinafter described.

Each of the pan screens bears a suitable discharge means such as illustrated with regard to pan screen 34. This comprises a side opening 68 in sleeve 58 which is connected to a discharge spout such as 70 which can be connected to suitable solids receiving facilities for the collection of solids separated by the screen member.

The box assembly 32 preferably also contains suitable screen sweep means such as the under screen sweeps 72 and 74 which have a plurality of radial arms such as 76 and 78 that extend from a central hub 80 in the form of an inverted cup 82 that overlies a central cylinder such as the upper end of center column 52 for the lowermost pan screen 38. Each of the radial arms bears a resilient screen contact member or wiper blade 77 formed of plastics such as Neoprene, Nylon, polyethylene, polypropylene or the like. The screen sweep 74 is supported by central cylinder 84 that is suspended by radial frame arms 86 which extend from the upper edges of the conical sleeve member for pan screen 36. Piston means generally indicated at 88 in center column 52 are provided in each of the support central cylinders and are pressured on their undersurface by a supply of compressed gas furnished through conduits 90 and 92 from air compressor 94. The construction of these pistons and the support of the screen sweeps will be described in greater detail hereinafter.

Figure 8:
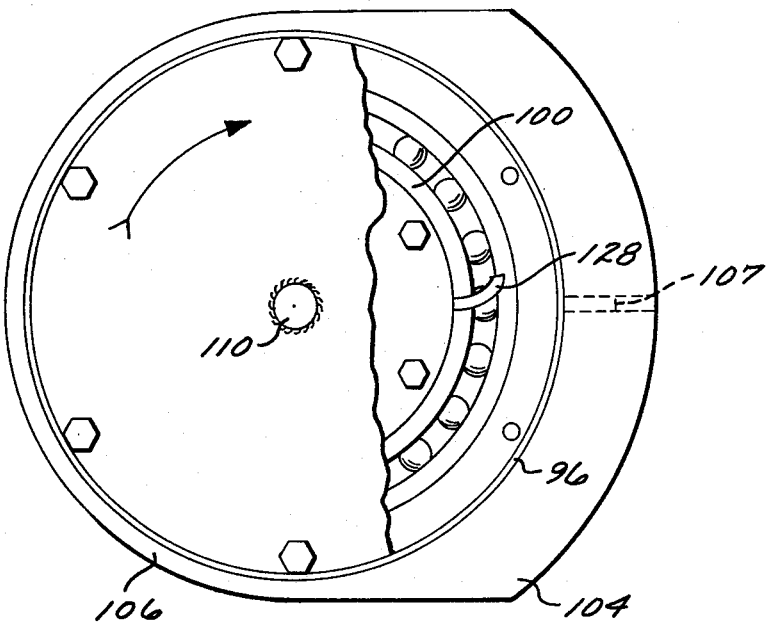
FIG. 8 is a sectional view through lines 8—8′ of FIG. 1 looking up.

The lower end of center column 52 is received within bearing sleeve 96 which supports upper roller bearing 98 and lower ball bearing 100 to provide rolling bearing support for the center column 52. The bearing shell 96 comprises an inertia gyration and bears, on its outer periphery, a plurality of eccentric weights 102 and 104 which, preferably, are located in the same plane as the upper and lower bearings, respectively. The bearing and weight relationship provides for maximum service life of the bearings. Because the inner bearing races are fixed relative to the outer races, the maximum radial force and speed capabilities of the bearings is achieved. Since the weights are on the bearing planes there is no significant bearing edge loading. As shown in FIG. 8, the eccentric weights are retained on the sleeve 96 by a band 106 which encircles sleeve 96 and are locked in position by set screw means 107 whereby the eccentricity and mass of these weights can be fixedly adjusted to impart the desired horizontal and vertical components to the gyration of the box assembly 32. The typical motion developed by the eccentric weights is a circular horizontal motion with a rocking action of sufficient amplitude and timing to influence movement of particles on the screens. Upper weight 102 generates, primarily, the desired horizontal circular motion while lower weight 104 provides the desired rocking motion.

The lower end of bearing sleeve 96 bears an end closure member 108 to which is attached shaft 110 which bears one of a pair of plate assemblies 112 and 114 which are interconnected by a plurality of outwardly looped elastomer bands such as 116 to provide a gyration isolating coupling between the gyration generator and the prime mover.

The bearing sleeve 96 also serves as a reservoir for lubricant such as a conventional lubricating oil and inludes a circulation system of tubing 118, 120 and filter 122 for circulating oil to the upper bearing race 98. An oil deflection baffle 124 is carried on center column 52 immediately beneath the upper bearing race 98 for collection of oil from the upper bearing race and has ports such as 126 for directing the oil down the side wall of the center column to contact the lower bearing race 100. The oil is circulated forcefully through the circulation system by pump means integral with the bearing sleeve. This pump means comprises pitot tube 128 (see FIG. 8) that is pointed along the inner periphery of the lower end of bearing sleeve 96 opposing its direction of rotation so that the oil will be forced through the circulation system.

The device is provided with a prime mover 130 which can be a conventional electric motor having an output shaft 132 that carries a drive pulley 134. Preferably, drive pulley 134 is of a variable pitch construction with split halves 136 and 138 and an outboard collar 140 that can be forced inwardly by lever 142, controlled by thumb screw 144, whereby the effective diameter of this pulley can be fixedly adjusted. The drive system includes belt 146 which extends to a spring-biased, split half pulley 148 that is carried on shaft 150 which is journaled in a support bearing within central sleeve 24. Shaft 150 bears a suitable drive pulley 152 for transmitting power to the auxiliary air compressor 94 by a V-belt drive 154. The upper end of shaft 150 carries the driving plate assembly 114 of the vibratory isolating coupling device previously mentioned.

Referring now to FIG. 2, the box assembly suspension means will be described in greater detail. As illustrated in FIG. 2, support leg 12 is shown extending to upper ring 28 that supports the base truss member 30 which extends upwardly and outwardly from the upper surface of the ring. Opposed to the base truss member 30 is the box assembly truss member 54 that extends downwardly from the radial gusset 50 and terminates subjacent thereto. The box assembly truss member 54 is positioned radially outwardly from the base truss member 30 such that the coil spring means 56 secured therebetween has lateral as well as vertical components. The construction of the spring suspension is further illustrated in FIG. 3 where it can be seen that the tension spring means for each of the truss member pairs comprises a pair of coil springs 56 and 57 which extend between retainer spools 59 that are formed of a suitable elastomer, typically molded of hard polyurethane and that have a central groove 61 for receiving and securing the end loops of the tension springs. The retainer spools are carried on the outboard ends of threaded shafts 53 and 55 which are rigidly secured to base support truss member 30 and box assembly truss member 54, respectively. To this end, the spool retainers 59 are formed with a central, internally threaded bore, permitting the spools to be turned onto the threaded ends of shafts 53 and 55.

The gyration isolation coupling, illustrated in FIGS. 4 and 5, comprises upper, driven plate assembly 112 and lower driving plate assembly 114 which are interconnected by a plurality of elastomer bands 116 which have adequate strength and resiliency to dampen destructive harmonic vibrations and transmit high tangential forces at start up of the device. The bands 116 are looped radially outwardly between the plate assemblies and are retained in the plate assemblies by upper plate 113 and lower plate 115 which are secured together by a plurality of conventional screw fasteners 117 and the like.

It has been found that a plurality of spaced and discontinuous bands 116 provide for the proper gyration isolation of the coupling, whereas the utilization of a continuous circular tire between the plates transmits destructive vibrations and harmonics of the gyration motion. Accordingly, it is preferred to employ a plurality of distinct bands 116 which are disposed about the periphery of the disk assemblies at equal and regular angular increments. Generally, the bands 116 should, in aggregate, extend from 25%-75% of the periphery of the disk assemblies and, most preferably, extend about 50% of the periphery as illustrated in FIG. 4. The plate assemblies of the driven plate 112 and driving plate 114 bear a center hub 119 with means such as bore 121 for receiving a roll pin for the detachable mounting of the isolating coupling to shaft 110 of the gyratory generator and shaft 150 connected to the prime mover.

The diameter of plates 112 and 114 and, hence, radial locations of the points of attachment of bands 116 is selected to achieve the desired isolation characteristics of the coupling. The coupling becomes increasingly more stiff with lesser vibration isolation as the radial distance of band attachment is increased. As this radial distance is descreased, however, the bands experience greater stress and fail more frequently. Accordingly, selection of the diameter of disks 112 and 114 and radial distance of attachment of the bands 116 is made by balancing these opposing factors.

Referring to FIGS. 6 and 7, the support and rotary motion drive for the lower screen deblinding means will be described. As illustrated in FIG. 6, the upper end of center column 52 terminates, open-endedly and receives a piston assembly 88. A closure plate 51 is provided in the upper portion of center column 52 to provide a closed cylindrical cavity beneath piston assembly 88. Tubing 90, which extends from the air pump facilities 94, communicates to the interior of this cylinder, beneath piston assembly 88 through a sealed grommet 91 which provides an inlet port to the cavity.

The screen sweep is illustrated with radial arms such as 76 and 78 previously described which extend outwardly from the center hub generally indicated at 80. Hub 80 is formed by an inverted cup 82 that overlies the upper end of center column 52 to provide annulus 81 therebetween. The outer periphery of the upper end of center column 52 bears a plurality of axial ribs 83 which are molded in a circular band 85 that encircles the upper end of center column 52 and is secured thereto by any suitable means, e.g., band clamp 37 and the like. The center column 52 and attached band 85 with axial ribs 83 move in a horizontal circle when viewed from above as shown by the arrowhead line A in FIG. 7. An instantaneous velocity vector of a point on the center column is as shown by arrowhead line B. The screen sweep with its inverted cup hub 80 is free to move horizontally on the air bearing cushion. Since this sweep is of substantial mass and inertia, it is influenced to move in a rotary mode by contact with the axial ribs 83 at the top and left side of FIG. 7 and in the direction of vector B. The force vector transmitted by axial ribs 83 to the cup hub 80 reorient and progress in a counterclockwise mode as rapidly as the rotation of the bearing shell 96, e.g., 20 cycles per second at an input rotational speed of 1200 r.p.m. as a result of the eccentric weights 102 and 104 carried by bearing shell 96. The actual rotation of the screen sweep under these conditions has been observed to be typically 6 r.p.m. at a horizontal peak to peak amplitude of 3/16 inch working under a dry 16-mesh screen, the lesser rotational velocity resulting from resistance to rotation by contact of the sweep arms with the underside of the screen and consequential slippage of axial ribs 83 on the interior walls of the cup 82.

The cup hub 80 is supported by an air cushion which is created on the top side of piston 88. Piston 88 is formed with a molded cap 87 having a peripheral lip that overlies the end face of center column 52. This cap is retained in assembly with a piston cup 75 which has skirts 89 that sealably engage the inner walls of center column 52 to provide a sealed and sliding contact therewith. Suitable fastening means such as machine bolts 91 complete the assembly. The center portion of piston assembly 88 has an axial port 93 with a closure member 95 threadably engaged therein to provide a port of fixedly adjustable discharge area, thereby permitting a controllable discharge of pressure gas to the upper surface of piston 88 and formation of an air cushion or bearing for the hub 80. The gas flowing over piston assembly 88 deflects downwardly through the annulus 81 and sweeps this annulus clean to remove solids and prevent their accumulation within the annulus, thereby insuring free rotational movement of the screen sweep. The lifting force of wipers 77 against the undersurface of a screen 60 can be controlled by the gas pressure and flow rate supplied through line 90, thereby providing control over the cleaning action on the screen.

Figure 9:
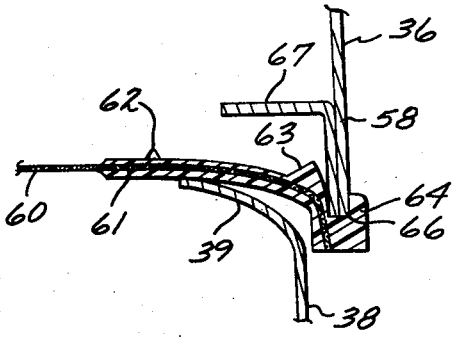
FIGS. 9 and 10 illustrate the resilient screen support and tensioning in the box assembly.
Figure 10:
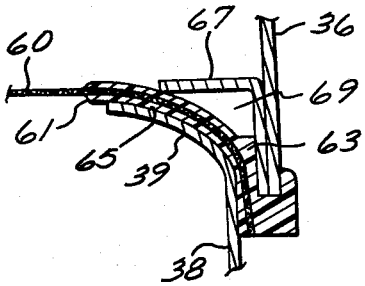

Referring now to FIGS. 9 and 10, the means for maintaining screen tension to resist vibration of the screens under the gyratory and harmonic movements of the box will be discussed. As illustrated in FIG. 9, each screen 60 bears a ring 62 about its outer periphery. This ring extends over a substantial annular width 61 of the periphery of the screen 60 which is molded in the ring 62. The ring 62 is formed of a suitable thermoplastic, e.g., polyurethane, Neoprene, polysulphide, or other moldable plastic capable of transmitting the necessary tension and shear forces to the screen to compensate for screen stretching. FIG. 9 illustrates the cross section of the ring 61 before the frames and screens are assembled in the box assembly and before tension is applied to the screens. Ring 62 bears an outer rim 64 which has an annular groove 66 for receiving the lower end of the cylindrical frame 58 of a pan screen such as 34, 36 or 38, previously described with regard to FIG. 1. As illustrated in FIG. 9, the pan screen, e.g., 36, is positioned over the subjacent pan screen 38 which has its upper end in telescopic reception of the screen 60 and superior pan screen frame 58. The upper end of the pan screen frame is curved inwardly along radius 39 to provide a smooth abutment surface on which is received the undersurface of ring 62.

Referring now to FIG. 10, the screen and screen frame means are shown in the assembled condition. As there illustrated, the upper pan screen frame 36 has been forced downwardly over the upper end of the subjacent pan screen frame 38 resulting in radial tensioning of the screen 60. Ring 61 is placed in shear and tension as the pan screens are clamped tightly into the box assembly and as the undersurface 65 of ring 61 is pulled snugly over the arcuate upper end of pan screen 38. Sealing ring 67 is pulled into contact with upper surface of ring 61 sealing annular void 69 from the pulverant material undergoing classification. Preferably, the ring 61 is formed with an annular shoulder 63 that serves as an abutment for bearing against the received lower edge of the superior screen frame of pan screen 36.

Figure 11:
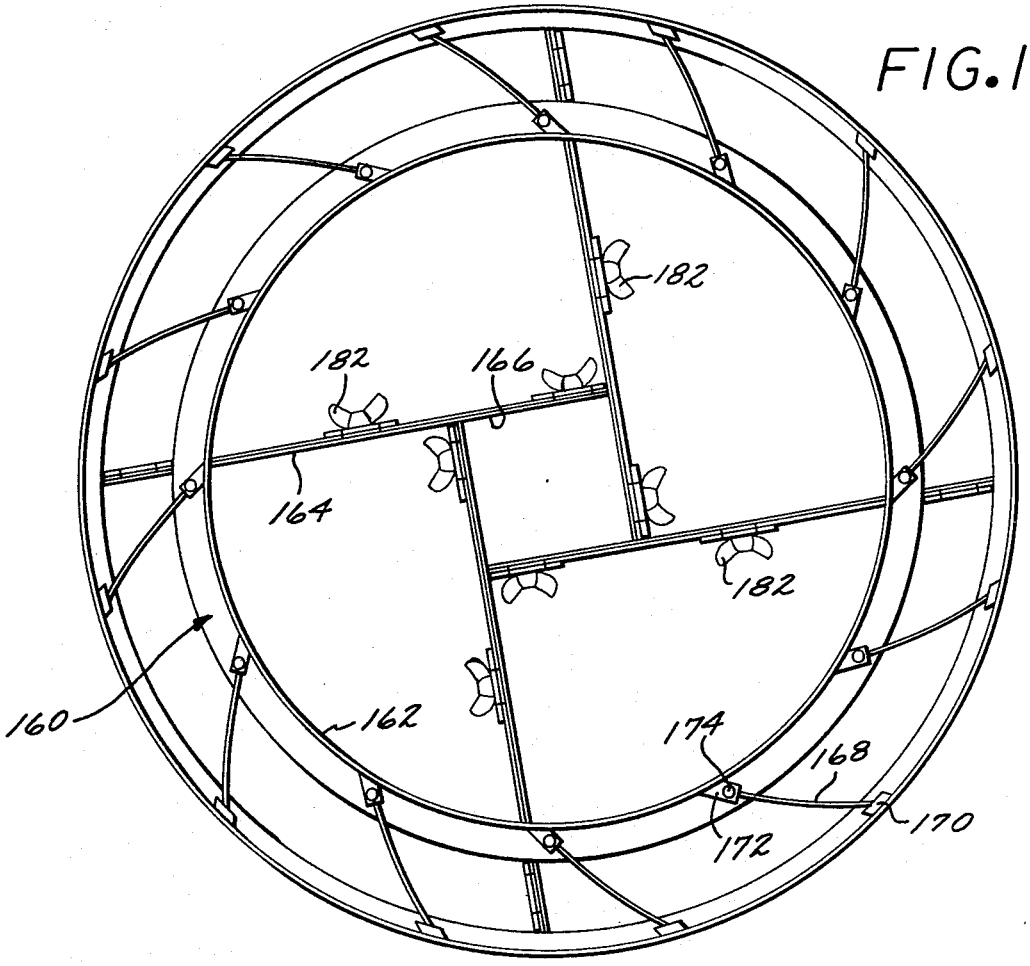
FIGS. 11 and 12 illustrate the upper screen sweep used in the invention.
Figure 12:
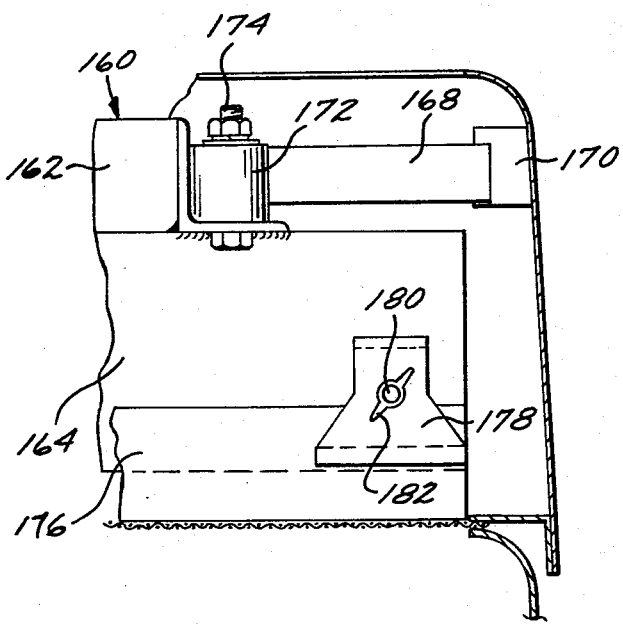

Referring now to FIGS. 11 and 12, there is illustrated the upper screen sweep useful in the invention. The upper screen sweep is generally indicated at 160 and comprises a frame defined by a generally circular rim 162 on which are mounted a plurality of cross arms 164 which extend along partial chordal lines and intersect at the midportion of the frame to provide an open box 166 at the center of the frame. Disposed about the periphery and on the underside of rim 162 are a plurality of rotary motion generators in the form of leaf springs 168 which bear, at their outboard ends, shoes formed of a resilient elastomer such as polyurethane and the like 170, and which are secured to the frame by mounting blocks 172 clamped to the frame by a conventional machine bolt 174.

Referring now to FIG. 12, it can be seen that the upper screen sweep 160 has arms 164 carried on the undersurface of ring 162. Attached to the under edge of arms 164 are screen wipers such as a strip 176 of an elastomer. A plurality of bristle brushes could also be used. The screen wipers 176 can be secured to the arms 164 by any convenient means. Toe clamps 178 are illustrated; these are metal plates attached to arms 164 by threaded fastening means such as stud 180 on which is secured wing nut 182, compressing the lower edge of clamp 178 against the screen wiper 176. The shoes extend outboard of the ring 162 where they can engage the inner peripheral wall of a pan screen frame to impart a rotary motion to the upper screen sweep when the box assembly is moved in its gyratory manner similar to the action previously described with regard to the motion developed by axial ribs 83 for rotating the lower screen sweep.

The invention has been described with reference to the illustrated and presently preferred embodiment. It is not intended that the invention be unduly limited by the discussion of the illustrated and preferred embodiment. Instead, it is intended that the invention be defined by the means and their obvious equivalents set forth in the following claims.

What is claimed is:

1. A vibratory device comprising:

a. box means resiliently mounted on a support base for vibratory motion thereon;

b. at least three support truss members circumferentially disposed about said base;

c. opposite box truss members extending subjacent and laterally outward of said base support truss members;

d. helical coil springs in tension between said box and base truss members for the resilient suspension of said box means on said base; and e. retainer spools carried on said truss members and having peripheral grooves receiving loop ends of said helical coil springs.

2. The vibratory device of claim 1 wherein each of said truss members bears shaft means projecting outwardly on each side thereof, and carrying therebetween pairs of said coil spring and retainer spools.

3. The vibratory device of claim 2 wherein said spools are of molded plastics.

4. The vibratory device of claim 2 wherein said shaft means are threaded to fixedly engage said spools.

5. The vibratory device of claim 1 wherein said box means comprises a separatory assembly having at least one planar screen means at an intermediate height thereof.

6. The vibratory device of claim 1 wherein said separatory assembly comprises a box assembly of a plurality of pan screen means in a stacked array secured by box assembly retaining means.

7. The vibratory device of claim 6 wherein said box assembly retaining means comprises a plurality of tie rods disposed about the outer periphery of said box assembly.

8. A vibratory device comprising an assembly of a plurality of pan screen means in a stacked array secured by assembly retaining tie rod means disposed about the periphery of said assembly, each of said pan screen means comprising a sleeve frame and a circular screen bearing an elastomeric ring about its periphery, said ring having rim means bearing a circular groove about its inner periphery to receive the lower edge of said sleeve frame and receiving on its opposite side a conical upper end of a subjacent pan screen whereby compression of said assembly effects radial deflection of said elastomeric rings and places the screens in tension in said box assembly, said assembly mounted on a support base by resilient means permitting vibratory motion thereon.

9. A vibratory device comprising:

box means mounted on a center column secured to the undersurface thereof;

a shell receiving said center column with an annular space therebetween in which are mounted upper and lower bearings extending between said column and shell;

said shell resiliently mounted on a support base for vibratory motion thereon and connected to a prime mover by a gyration isolation coupling comprising a pair of spaced-apart plates interconnected with a pair of elastomeric bands that loop outwardly radially and axially between said plates;

and gyration generation means comprising weights eccentrically carried on the outside wall of said bearing shell to provide an eccentrically loaded bearing shell.

10. The vibratory device of claim 9 wherein each of said plates is an assembly of first and second discs receiving the ends of said elastomeric bands therebetween and secured in assembly by fastener means extending through said bands.

11. The vibratory device of claim 9 wherein three of said bands are provided.

12. The vibratory device of claim 9 wherein said weights are located in the same planes as said upper and lower bearings.

13. The vibratory device of claim 12 wherein said bearings are rolling contact bearings.

14. The vibratory device of claim 12 wherein the eccentricity of said weights on said bearing shell is fixedly adjustable.

15. The vibratory device of claim 9 including lubricant circulation means to supply lubricant to said bearings.

16. A vibratory device comprising: a box assembly of a plurality of pan screens with the lowermost pan screen secured to a center column that extends open-endedly through the bottom of the lowermost of said pan screen means and that is mounted on a support base by means permitting vibratory motion thereon; screen sweep means in the form of an assembly of radial arms carried by an inverted cup hub overlying said open-ended center column; and flexible axial ribs carried on the outside wall of said center column and extending across the annulus between said column and inner wall of said cup hub and contacting said inner wall to impart rotation to said screen sweep means.

17. The vibratory device of claim 16 wherein said center column has a closure plate in its upper portion and including piston means carried in said center column and pressured gas supply means communicating with said center column between said closure plate and said piston means to force said piston means against the undersurface of said cup and support said screen sweep means.

18. The vibratory device of claim 17 including gas port means in said piston means to vent gas against the undersurface of said cup and provide a gas bearing between said piston means and said cup.

19. A vibratory device comprising an assembly of pan screen means in a stacked array secured by assembly retaining tie rod means disposed about the periphery of said assembly, a base of at least three truss support members and resilient means in tension between said truss members and said assembly whereby said assembly is mounted for vibratory movement on said base; and upper screen sweep means carried on the upper surface of at least one of said pan screens and comprising a frame, screen contact members resting on said pan screen and a plurality of leaf springs bearing outboard shoes to contact the wall of said pan and carried at spaced angular increments about said frame and inclined to the radius thereof to impart rotary motion to said screen sweep means.

20. A vibratory device comprising:

box means mounted on a center column secured to the undersurface thereof;

a shell receiving said center column resiliently mounted on a support base with means permitting vibratory motion thereon;

shaft means coupled to said shell and mechanically connected to a prime mover for rotational movement;

weighted means eccentrically carried on said shell for inducing said vibratory motion upon rotation thereof;

bearing means carried interiorly of said shell and permitting rotation of said shell about said center column;

lubricating means for said bearing means comprising a bottom closure plate on said shell to form a lubrication reservoir; and lubrication circulation means including a stationary pitot tube carried by said center column and positioned in said oil reservoir whereby lubricant contained in said reservoir is rotated with said bearing shell to develop a static pressure at the inlet of said pitot tube.

21. The vibratory device of claim 20 wherein said pitot tube is located at the bottom inner periphery of said bearing shell.

22. The vibratory device of claim 20 including lubricant filter means receiving lubricant from said pitot tube.

* * * * *